US007230053B2

(12) United States Patent
Higuchi et al.

(10) Patent No.: US 7,230,053 B2
(45) Date of Patent: Jun. 12, 2007

(54) GOLF BALL

(75) Inventors: Hiroshi Higuchi, Chichibu (JP); Nobuyuki Kataoka, Chichibu (JP); Atsushi Nanba, Chichibu (JP); Yasuo Wakatsuki, Shiki (JP); Shojiro Kaita, Shiki (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 178 days.

(21) Appl. No.: 10/959,221

(22) Filed: Oct. 7, 2004

(65) Prior Publication Data

US 2005/0079930 A1 Apr. 14, 2005

(30) Foreign Application Priority Data

Oct. 9, 2003 (JP) ..... 2003-350660

(51) Int. Cl.
*A63B 37/06* (2006.01)

(52) U.S. Cl. ..... 525/193; 525/261; 525/263; 525/265; 525/269; 525/274; 473/371; 473/372

(58) Field of Classification Search ..... None
See application file for complete search history.

(56) References Cited

U.S. PATENT DOCUMENTS

| | | | | |
|---|---|---|---|---|
| 6,596,828 | B1 | 7/2003 | Kaito et al. | |
| 6,692,381 | B2 | 2/2004 | Sakagami et al. | |
| 2002/0137848 | A1* | 9/2002 | Sone et al. | 525/192 |
| 2003/0050135 | A1 | 3/2003 | Sakagami et al. | |
| 2003/0073513 | A1* | 4/2003 | Sakagami et al. | 473/367 |

FOREIGN PATENT DOCUMENTS

| | | | |
|---|---|---|---|
| EP | 1086957 | * | 3/2001 |
| JP | 11-35633 | A | 2/1999 |
| JP | 11-164912 | A | 6/1999 |
| JP | 2000-313710 | A | 11/2000 |
| JP | 2002-282393 | A | 10/2002 |
| JP | 2002-293996 | A | 10/2002 |
| JP | 2002-338737 | A | 11/2002 |

OTHER PUBLICATIONS

Fine Chemical, vol. 23, No. 9, Jun. 1, 1994, pp. 5-15.
M. Mason et al., "Hydrolysis of Tri-*tert*-butylaluminum: The First Structural Characterization of Alkylalumoxanes $[(R_2Al)_2O]_n$ and $(RA10)_n$", *J. Am. Chem. Soc.*, vol. 115, 1993, pp. 4971-4984.
C. Harlan et al., "Three-Coordinate Aluminum Is Not a Prerequisite for Catalytic Activity in Zirconocene-Alumoxane Polymerization of Ethylene", *J. Am. Chem. Soc.*, vol. 117, 1995, pp. 6465-6474.

* cited by examiner

*Primary Examiner*—David J. Buttner
(74) *Attorney, Agent, or Firm*—Sughrue Mion, PLLC

(57) ABSTRACT

A golf ball, typically its core, is manufactured by molding and vulcanizing a rubber composition comprising a base rubber, an unsaturated carboxylic acid or a metal salt thereof, an inorganic filler, an organic peroxide, and an organosulfur compound. The base rubber contains a polybutadiene having a Mw of 60–150×$10^4$ and a Mw/Mn of up to 2.0 and containing at least 98% of cis-1,4 bonds and up to 1.5% of trans-1,4 bonds. The composition is easy to mold and work, and the golf ball has good rebound and improved flight performance.

4 Claims, No Drawings

GOLF BALL

CROSS-REFERENCE TO RELATED APPLICATION

This non-provisional application claims priority under 35 U.S.C. §119(a) on Patent Application No. 2003-350660 filed in Japan on Oct. 9, 2003, the entire contents of which are hereby incorporated by reference.

TECHNICAL FIELD

This invention relates to a golf ball having good rebound, improved flight performance, and an enhanced ability of molding and working, especially by extrusion.

BACKGROUND ART

For the purpose of endowing golf balls with better rebound, efforts have been made to ameliorate the formulation of polybutadiene used as the rubber base.

For example, JP-A 2000-313710 aims to develop a polymer having high thermal properties (e.g., thermal stability) and mechanical properties (e.g., tensile modulus and flexural modulus), and discloses a catalyst composition which enables to produce a conjugated diene polymer having a high content of cis-1,4 units in the micro-structure and a narrow molecular weight distribution. JP-A 2002-282393 and JP-A 2002-338737 describe solid golf balls having improved flight performance in which the solid core is formed mainly from a polybutadiene rubber obtained using the catalyst composition of JP-A 2000-313710.

For these golf balls, however, there is still left a room for further improvement in rebound and the property of molding and working.

SUMMARY OF THE INVENTION

An object of the invention is to provide a golf ball having good rebound, improved flight performance, and the advantage of efficient manufacture due to an enhanced ability of molding and working, especially by extrusion.

The present invention addresses a golf ball comprising as a constituent component a molded and vulcanized product of a rubber composition comprising suitable amounts of a base rubber, an unsaturated carboxylic acid or a metal salt thereof, an inorganic filler, an organic peroxide, and an organosulfur compound. It has been found that the golf ball is improved in rebound when the base rubber contains a first polybutadiene having a weight average molecular weight (Mw) of $60\times10^4$ to $150\times10^4$ and a dispersity (Mw/Mn) of up to 2.0, and containing at least 98% of cis-1,4 bonds and up to 1.5% of trans-1,4 bonds in the molecule, and the molded and vulcanized product has a resilience of at least 74%. Particularly when the base rubber is a blend of the first polybutadiene and a second polybutadiene having a dispersity (Mw/Mn) of 2.0 to 6.0, containing at least 60% of cis-1,4 bonds in the molecule, and having a Mooney viscosity ($ML_{1+4}$(100° C.)) of up to 55, the property of molding and working, especially by extrusion, can be improved while minimizing a drop of rebound.

Thus the present invention provides a golf ball comprising as a constituent component a molded and vulcanized product of a rubber composition comprising (A) 100 parts by weight of a base rubber, (B) 10 to 60 parts by weight of an unsaturated carboxylic acid and/or a metal salt thereof, (C) 1 to 80 parts by weight of an inorganic filler, (D) 0.05 to 3 parts by weight of an organic peroxide, and (E) 0.1 to 5 parts by weight of an organosulfur compound. The component (A) comprises (A-1) a polybutadiene having a weight average molecular weight (Mw) of $60\times10^4$ to $150\times10^4$ and a dispersity (Mw/Mn) of up to 2.0, and containing at least 98% of cis-1,4 bonds and up to 1.5% of trans-1,4 bonds in the molecule. The molded and vulcanized product has a resilience of at least 74%.

In a preferred embodiment, component (A) comprises (A-1) 50 to 95% by weight of the (first) polybutadiene and (A-2) 5 to 50% by weight of a second polybutadiene having a dispersity (Mw/Mn) of 2.0 to 6.0, containing at least 60% of cis-1,4 bonds in the molecule, and having a Mooney viscosity ($ML_{1+4}$(100° C.)) of up to 55. Preferably, the first polybutadiene (A-1) has been synthesized in the presence of a catalyst composition comprising a metallocene complex of a rare earth metal compound and at least one of an ionic compound of a non-coordinate anion and a cation and an aluminoxane. Also preferably, the second polybutadiene (A-2) has been synthesized in the presence of a catalyst comprising a lanthanide series rare-earth compound, an organoaluminum compound, an alumoxane, and a halogen-containing organic compound. The molded and vulcanized product is typically used as a solid core of a two-piece solid golf ball or a three or multi-piece solid golf ball.

The golf ball of the invention exhibits good rebound and improved flight performance, and can be efficiently manufactured since the rubber composition is effectively moldable and workable.

DESCRIPTION OF THE PREFERRED EMBODIMENTS

Note that "parts" refers hereinafter to parts by weight.

The golf ball of the invention has as a constituent component a molded and vulcanized product of a rubber composition comprising (A) a base rubber, (B) an unsaturated carboxylic acid and/or a metal salt thereof, (C) an inorganic filler, (D) an organic peroxide, and (E) an organosulfur compound.

Component A

The base rubber should contain (A-1) a first polybutadiene having a weight average molecular weight (Mw) of $60\times10^4$ to $150\times10^4$ and a dispersity (Mw/Mn) of up to 2.0, and containing at least 98% of cis-1,4 bonds and up to 1.5% of trans-1,4 bonds in the molecule, and optionally (A-2) a second polybutadiene having a dispersity (Mw/Mn) of 2.0 to 6.0, containing at least 60% of cis-1,4 bonds in the molecule, and having a Mooney viscosity ($ML_{1+4}$ (100° C.)) of up to 55. The inclusion of (A-2) is preferred for allowing the rubber composition to be more effectively extrusion workable.

As used herein, weight average molecular weight (Mw) and dispersity (Mw/Mn, also referred to as molecular weight distribution or polydispersity index) are determined by gel permeation chromatography (GPC) with polystyrene standards, using an instrument TOSOH HLC-8220GPC (solvent tetrahydrofuran, measurement temperature 40° C., and columns Super HZM-Hx3).

For endowing the golf ball with better rebound, it is preferred to use as component (A-1) a polybutadiene which has been synthesized in the presence of a catalyst composition comprising a metallocene complex of a rare earth metal compound and at least one of an ionic compound of a non-coordinate anion and a cation and an aluminoxane.

Typical of the metallocene complex of rare earth metal compound are divalent or trivalent rare earth metal compounds having the general formulae (I) and (II).

$$R_aMX_b \cdot L_c \quad (I)$$

$$R_aMX_bQX_b \quad (II)$$

Herein M is a rare earth metal, R is a cyclopentadienyl, substituted cyclopentadienyl, indenyl, substituted indenyl, fluorenyl, or substituted fluorenyl group, X is a hydrogen atom, halogen atom, alkoxide, thiolate, amide, or hydrocarbon group of 1 to 20 carbon atoms, L is a Lewis basic compound, and Q is a Group III element in the Periodic Table. The subscript "a" is an integer of 1 to 3, b is an integer of 0 to 2, and c is an integer of 0 to 2.

In formula (I), M is a rare earth metal selected from atomic number 57 to 71 in the Periodic Table. Exemplary rare earth metals include lanthanum, cerium, praseodymium, neodymium, promethium, samarium, europium, gadolinium, terbium, dysprosium, holmium, erbium, thulium, ytterbium, and lutetium. From the rebound standpoint, samarium and gadolinium are preferred. In the event a=2, two R's may be the same or different. Similarly, in the event b or c=2, two X's or L's may be the same or different.

Illustrative examples of the metallocene complex of rare earth metal compound represented by formula (I) include bis(pentamethylcyclopentadienyl)bis(tetrahydrofuran)samarium, methylbis(pentamethylcyclopentadienyl)tetrahydrofuransamarium, chlorobis(pentamethylcyclopentadienyl) tetrahydrofuransamarium, and iodobis (pentamethylcyclopentadienyl)tetrahydrofuransamarium. Exemplary of the metallocene complex of rare earth metal compound represented by formula (II) is dimethylaluminum (μ-dimethyl)bis(pentamethylcyclopentadienyl)-samarium.

The ionic compound which can be used as the co-catalyst is not particularly limited as long as it consists of a non-coordinate anion and a cation. Included are ionic compounds which can react with the above-mentioned rare earth metal compounds to form cationic transition metal compounds, for example.

The ionic compound is preferably a combination of any of non-coordinate anions with any of cations. Preferred examples of the ionic compound include triphenylcarbonium tetrakis(pentafluorophenyl)borate, triphenylcarbonium tetrakis(tetrafluorophenyl)borate, N,N-dimethylanilinium tetrakis(pentafluorophenyl)borate, and 1,1'-dimethylferrocenium tetrakis(pentafluorophenyl)borate. The ionic compounds may be used alone or in admixture of two or more. Examples of the Lewis acid that can react with a transition metal compound to form a cationic transition metal compound include $B(C_6F_5)_3$ and $Al(C_6F_5)_3$, which may be used in combination with the foregoing ionic compound.

The aluminoxane which can be used as the co-catalyst is typically obtained by contacting an organoaluminum compound with a condensing agent. More specifically, there may be used a straight or cyclic aluminoxane represented by the general formula: $(—Al(R')O—)_n$ wherein R' is a hydrocarbon group of 1 to 10 carbon atoms which may be substituted with one or more halogen atoms and/or alkoxy groups and n representing a degree of polymerization is preferably at least 5, more preferably at least 10. Examples of the hydrocarbon group represented by R' include methyl, ethyl, propyl and isobutyl, with methyl being preferred. Examples of the organoaluminum compound from which the aluminoxane is prepared include trialkylaluminums such as trimethylaluminum, triethylaluminum, triisobutylaluminum and mixtures thereof, with trimethylaluminum being most preferred. The aluminoxane prepared from a mixture of trimethylaluminum and tributylaluminum is also preferably used. The aluminoxane may be used in combination with the ionic compound.

In the catalyst composition used in the preparation of the first polybutadiene, organometallic compounds of Group I to III elements in the Periodic Table may be incorporated. Typical organometallic compounds of Group I to III elements in the Periodic Table include organoaluminum compounds, organolithium compounds, organomagnesium compounds, organozinc compounds and organoboron compounds. Specific examples include methyllithium, butyllithium, phenyllithium, benzyllithium, neopentyllithium, trimethylsilyllithium, bistrimethylsilylmethyllithium, dibutylmagnesium, dihexylmagnesium, diethylzinc, dimethylzinc, trimethylaluminum, triethylaluminum, triisobutylaluminum, trihexylaluminum, trioctylaluminum, tridecylaluminum, etc. Also useful are organometallic halides such as ethylmagnesium chloride, butylmagnesium chloride, dimethylaluminum chloride, diethylaluminum chloride, sesquiethylaluminum chloride and ethylaluminum dichloride, and hydrogenated organometallic compounds such as diethylaluminum hydride and sesquiethylaluminum hydride. These organometallic compounds may be used in combination of two or more.

In the catalyst composition, the metallocene complex of rare earth metal compound and the ionic compound of non-coordinate anion and cation and/or the aluminoxane are combined in a ratio which can be suitably selected depending on the type of monomers to be polymerized, the mode of reaction, and reaction conditions.

In a catalyst composition containing the metallocene complex of rare earth metal compound and the aluminoxane, the molar ratio of the metallocene complex of rare earth metal compound to the aluminoxane is typically from 1/1 to 1/10,000, preferably from 1/10 to 1/1,000, more preferably from 1/50 to 1/500. In a catalyst composition containing the metallocene complex of rare earth metal compound and the ionic compound, the molar ratio of the metallocene complex of rare earth metal compound to the ionic compound is typically from 1/0.1 to 1/10, preferably from 1/0.2 to 1/5, more preferably from 1/0.5 to 1/2. When the organometallic compound of Group I to III element is additionally incorporated, the molar ratio of the metallocene complex of rare earth metal compound to the organometallic compound of Group I to III element is typically from 1/0.1 to 1/1,000, preferably from 1/0.2 to 1/500, more preferably from 1/0.5 to 1/50.

For polymerization in the presence of the above-mentioned catalyst composition, the polymerization temperature is typically in the range of −100° C. to 100° C., preferably −50° C. to 80° C. The polymerization time is typically about 1 minute to about 12 hours, preferably about 5 minutes to about 5 hours. The reaction conditions are not limited to the above ranges, because they can, of course, be suitably selected depending on the type of monomers and the type of catalyst composition. Once polymerization reaction reaches a predetermined level of polymerization, any well-known polymerization stopper is added to the polymerization system for interruption. Then the polymer thus produced can be separated from the reaction system by a conventional method.

For the polybutadiene (A-1), the content of cis-1,4 bonds in the butadiene molecule should be at least 98%, preferably at least 98.5%, more preferably at least 99%, most preferably at least 99.3%. The content of trans-1,4 bonds in the butadiene molecule should be up to 1.5%, preferably up to 1%, more preferably up to 0.7%, most preferably up to 0.5%. If the cis-1,4 bond content or trans-1,4 bond content is outside the range, the rubber composition becomes less rebound, failing to achieve the objects of the invention.

The polybutadiene (A-1) should have a weight average molecular weight (Mw) of at least $60\times10^4$, preferably at least $65\times10^4$, more preferably at least $70\times10^4$, most preferably at least $73\times10^4$, and the upper limit of Mw is up to $150\times10^4$. A polybutadiene with a Mw of less than $60\times10^4$ fails to provide sufficient rebound whereas a Mw in excess of $150\times10^4$ dramatically exacerbates the working property.

The polybutadiene (A-1) should have a dispersity (Mw/Mn) of typically at least 1.0, preferably at least 1.1 and up to 2.0, preferably up to 1.9, more preferably up to 1.7, even more preferably up to 1.5, most preferably up to 1.3. A polybutadiene with a dispersity in excess of 2.0 fails to provide sufficient rebound.

In the base rubber (A), the first polybutadiene (A-1) constitutes at least 50%, preferably at least 60%, more preferably at least 70%, even more preferably at least 80%, most preferably at least 85% by weight. The upper limit of the first polybutadiene content is typically up to 95%, preferably up to 93%, more preferably up to 88% by weight. If the proportion of first polybutadiene (A-1) in the base rubber is less than 50% by weight, sufficient rebound may not be obtainable. If the same proportion is more than 95% by weight, the working property may worsen.

With respect to the second polybutadiene (A-2), it is preferred for acquiring good working property while maintaining good rebound, to use a polybutadiene which has been synthesized in the presence of a catalyst comprising a lanthanide series rare-earth compound, an organoaluminum compound, an alumoxane, a halogen-containing organic compound, and optionally a Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ wherein $R^1$, $R^2$ and $R^3$ are each independently a hydrogen or a hydrocarbon residue of 1 to 8 carbons.

Preferred alumoxanes include compounds of the structures shown by formulas (IV) and (V) below. The alumoxane association complexes described in Fine Chemical, 23, No. 9, 5 (1994), J. Am. Chem. Soc., 115, 4971 (1993), and J. Am. Chem. Soc., 117, 6465 (1995) are also acceptable.

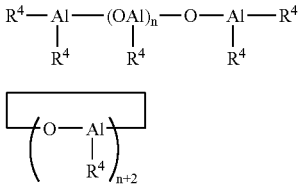

(IV)

(V)

In the above formulas, $R^4$ is a hydrocarbon group having 1 to 20 carbon atoms, and n is an integer of at least 2.

Examples of halogen-containing compounds that may be used include aluminum halides of the formula $AlX_nR_{3-n}$ (wherein X is a halogen; R is a hydrocarbon residue of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base may be any Lewis base that can be used to form a complex with the lanthanide series rare-earth compound. Illustrative examples include acetylacetone and ketone alcohols.

Herein, the use of a neodymium catalyst in which a neodymium compound serves as the lanthanide series rare-earth compound is advantageous because it enables a polybutadiene rubber having a high cis-1,4 unit content and a low 1,2-vinyl unit content to be obtained at an excellent polymerization activity. Preferred examples of such rare-earth catalysts include those mentioned in JP-A 11-35633.

To produce a polybutadiene having a cis unit content within the above range and a dispersity (Mw/Mn) within the above-described range, it is preferable for the polymerization of butadiene in the presence of a rare-earth catalyst containing a lanthanide series rare-earth compound to be carried out at a butadiene/(lanthanide series rare-earth compound) molar ratio of generally 1,000 to 2,000,000, and especially 5,000 to 1,000,000, and at an $AlR^1R^2R^3$/(lanthanide series rare-earth compound) molar ratio of generally 1 to 1,000, and especially 3 to 500. It is also preferable for the (halogen compound)/(lanthanide series rare-earth compound) molar ratio to be generally 0.1 to 30, and especially 0.2 to 15, and for the (Lewis base)/(lanthanide series rare-earth compound) molar ratio to be generally 0 to 30, and especially 1 to 10.

The polymerization of butadiene in the presence of a rare-earth catalyst may be carried out by bulk polymerization or vapor phase polymerization, either with or without the use of solvent, and at a polymerization temperature of generally −30° C. to 150° C., and preferably 10° C. to 100° C.

The second polybutadiene (A-2) may instead be one obtained by polymerizing butadiene using the above-described rare-earth catalyst, then reacting a terminal modifier with active end groups on the polymer.

Such modified polybutadiene rubbers can be obtained by polymerization as described above, followed by the use of a terminal modifier selected from among types (i) to (vii) below.

(i) Alkoxysilyl group-bearing compounds that react with active end groups on the polymer. Preferred alkoxysilyl group-bearing compounds are alkoxysilane compounds having at least one epoxy group or isocyanate group on the molecule. Specific examples include epoxy group-bearing alkoxysilanes such as 3-glycidyloxypropyltrimethoxysilane, 3-glycidyloxypropyltriethoxysilane, (3-glycidyloxypropyl)methyldimethoxysilane, (3-glycidyloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, condensation products of 3-glycidyloxypropyltrimethoxysilane and condensation products of (3-glycidyloxypropyl)methyldimethoxysilane; and isocyanate group-bearing alkoxysilane compounds such as 3-isocyanatopropyltrimethoxysilane, 3-isocyanatopropyltriethoxysilane, (3-isocyanatopropyl)methyldimethoxysilane, (3-isocyanatopropyl)methyldiethoxysilane, condensation products of 3-isocyanatopropyltrimethoxysilane and condensation products of (3-isocyanatopropyl)methyldimethoxysilane.

A Lewis acid may be added to accelerate the reaction when the above alkoxysilyl group-bearing compound is reacted with active end groups on the polymer. The Lewis acid acts as a catalyst to promote the coupling reaction, thus improving cold flow by the modified polymer and providing a better shelf stability. Examples of suitable Lewis acids include dialkyltin dialkyl malates, dialkyltin dicarboxylates and aluminum trialkoxides.

Other types of terminal modifiers that may be used include:

(ii) halogenated organometallic compounds, halogenated metallic compounds and organometallic compounds of the general formulas $R^5_nM'X_{4-n}M'X_4$, $M'X_3$, $R_5{}_nM'(—R^6—COOR^7)_{4-n}$ or $R^5{}_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(iii) heterocumulene compounds having on the molecule a Y═C═Z linkage (wherein Y is a carbon, oxygen, nitrogen or sulfur atom; and Z is an oxygen, nitrogen or sulfur atom);

(iv) three-membered heterocyclic compounds containing on the molecule the following bonds:

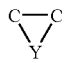

wherein Y is an oxygen, nitrogen or sulfur atom;

(v) halogenated isocyano compounds;

(vi) carboxylic acids, acid halides, ester compounds, carbonate compounds and acid anhydrides of the formula $R^8—(COOH)_m$, $R^9(COX)_m$, $R^{10}—(COO—R^{11})_m$, $R^{12}—OCOO—R^{13}$, $R^{14}—(COOCO—R^{15})_m$ or

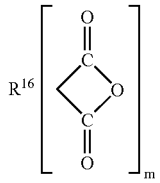

wherein $R^8$ to $R^{16}$ are each independently a hydrocarbon group of 1 to 50 carbons, X is a halogen atom, and m is an integer from 1 to 5; and (vii) carboxylic acid metal salts of the formula $R^{17}{}_1M''(OCOR^{18})_{4-1}$, $R^{19}{}_1M''(OCO—R^{20}—COOR^{21})_{4-1}$ or

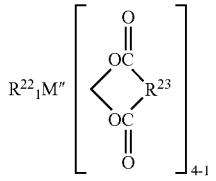

wherein $R^{17}$ to $R^{23}$ are each independently a hydrocarbon group of 1 to 20 carbons, M" is a tin, silicon or germanium atom, and the letter l is an integer from 0 to 3.

Specific examples of the terminal modifiers and methods for their reaction are described in, for example, JP-A 11-35633, JP-A 7-268132 and JP-A 2002-293996.

For the polybutadiene (A-2), the content of cis-1,4 bonds in the butadiene molecule should be at least 60%, preferably at least 80%, more preferably at least 90%, most preferably at least 95% by weight. A cis-1,4 bond content of less than 60% by weight may lead to a decline of rebound. The content of 1,2-vinyl bonds in the butadiene molecule should be up to 2%, preferably up to 1.7%, more preferably up to 1.5%. A 1,2-vinyl content of more than 2% may lead to a decline of rebound.

The second polybutadiene (A-2) has a Mooney viscosity ($ML_{1+4}$(100° C.)) of generally at least 10, preferably at least 15, more preferably at least 20, and even preferably at least 25, but generally up to 55, preferably up to 50, more preferably up to 45, even more preferably up to 40, and most preferably up to 37. The second polybutadiene having a Mooney viscosity of less than 10 may fail to provide sufficient rebound whereas a Mooney viscosity of more than 55 may worsen the working property.

The term "Mooney viscosity" used herein refers to an industrial index of viscosity (JIS K6300) as measured with a Mooney viscometer, which is a type of rotary plastometer. The unit symbol used here is $ML_{1+4}$(100° C.), where "M" stands for Mooney viscosity, "L" stands for large rotor (L-type), and "1+4" stands for a pre-heating time of 1 minute and a rotor rotation time of 4 minutes. The "100° C." indicates that measurement was carried out at a temperature of 100° C.

The second polybutadiene (A-2) should have a dispersity (Mw/Mn) of typically at least 2.0, preferably at least 2.2, more preferably at least 2.4, even more preferably at least 2.6, and up to 6.0, preferably up to 5.0, more preferably up to 4.0, even more preferably up to 3.4. A second polybutadiene with a dispersity of less than 2.0 fails to provide acceptable working property whereas a dispersity of more than 6.0 fails to provide sufficient rebound.

In the base rubber (A), the second polybutadiene (A-2) constitutes at least 5%, preferably at least 10%, more preferably at least 15% by weight. The upper limit of the second polybutadiene content is typically up to 50%, preferably up to 40%, more preferably up to 35%, even more preferably up to 30% by weight. If the proportion of second polybutadiene (A-2) in the base rubber is less than 5% by weight, acceptable working property may not be obtainable. If the same proportion is more than 50% by weight, rebound may lower.

In the base rubber, rubber components other than the above-mentioned polybutadienes may be compounded insofar as the benefits of the invention are not lost. Examples of such additional rubber components that may be used include polybutadienes other than the above-described polybutadienes, such as a polybutadiene obtained using a Group VIII metal compound catalyst, and other diene rubbers such as styrene-butadiene rubbers, natural rubbers, isoprene rubbers and ethylene-propylene-diene rubbers.

Component B

Examples of suitable unsaturated carboxylic acids include acrylic acid, methacrylic acid, maleic acid and fumaric acid. Acrylic acid and methacrylic acid are especially preferred. Examples of suitable unsaturated carboxylic acid metal salts include zinc salts and magnesium salts of the above unsaturated carboxylic acids. Of these, zinc acrylate is especially preferred.

The amount of component (B) per 100 parts of the base rubber as component (A) is generally at least 10 parts, preferably at least 13 parts, more preferably at least 16 parts, even more preferably at least 18 parts, and most preferably at least 20 parts, but generally not more than 60 parts, preferably not more than 50 parts, more preferably not more than 45 parts, even more preferably not more than 40 parts, and most preferably not more than 35 parts. Less than 10 parts of component (B) per 100 parts of the base rubber may fail to provide a sufficient hardness to achieve the object of the invention. More than 60 parts of component (B) provides a product which has a too high hardness and is awkward to use, failing to achieve the object of the invention.

Component C

Suitable inorganic fillers include zinc oxide, barium sulfate and calcium carbonate. The amount of component (C) per 100 parts of the base rubber as component (A) is generally at least 1 part, preferably at least 5 parts, more preferably at least 9 parts, even more preferably at least 13 parts, but generally not more than 80 parts, preferably not more than 65 parts, more preferably not more than 50 parts, even more preferably not more than 40 parts. Amounts of the inorganic filler (C) outside the range fail to provide an appropriate weight and optimum rebound.

Component D

Suitable organic peroxides include dicumyl peroxide, 1,1-bis(t-butylperoxy)-3,3,5-trimethylcyclohexane, 1,1-bis(t-butylperoxy)cyclohexane and α,α'-bis(t-butylperoxy)diisopropylbenzene. These organic peroxides may be commercially available products, such as Percumyl D and Perhexa 3M (NOF Corporation) and Luperco 231XL (Atochem Co.).

One, two or more organic peroxides may be used as component (D). Use of two or more organic peroxides is preferred for rebound. Provided that an organic peroxide having the shortest half-life at 155° C. is designated (D-1), another organic peroxide having the longest half-life at 155° C. is designated (D-2), the half-life of (D-1) is designated t(D-1), and the half-life of (D-2) is designated t(D-2), the ratio of half-lives t(D-2)/t(D-1) should be at least 7, preferably at least 8, more preferably at least 9, even more preferably at least 10, and preferably up to 20, more preferably up to 18, even more preferably up to 16, most preferably up to 14. Even when two or more organic peroxides are used, a half-life ratio outside the range may lead to poor rebound, compression and durability.

Herein, the half-life t(D-1) at 155° C. of the peroxide (D-1) is preferably at least 5 seconds, more preferably at least 10 seconds, even more preferably at least 15 seconds, and up to 120 seconds, more preferably up to 90 seconds, even more preferably up to 60 seconds. The half-life t(D-2) at 155° C. of the peroxide (D-2) is preferably at least 300 seconds, more preferably at least 360 seconds, even more preferably at least 420 seconds, and preferably up to 800 seconds, more preferably up to 700 seconds, even more preferably up to 600 seconds. In this context, the preferred organic peroxide (D-1) is 1,1-bis(t-butylperoxy)-3,3,5-trimethylcyclohexane, and the preferred organic peroxide (D-2) is dicumyl peroxide.

The total content of the organic peroxides including (D-1) and (D-2) is at least 0.05 part, preferably at least 0.1 part, more preferably at least 0.15 part, and up to 3 parts, preferably up to 2 parts, more preferably up to 1 part, even more preferably up to 0.8 part, most preferably up to 0.6 part, per 100 parts of the base rubber (A). Too low an organic peroxide content leads to an extended time required for crosslinking, a substantial lowering of productivity, and a substantial lowering of compression, failing to achieve the objects of the invention. With too high a content, rebound and durability decline, failing to achieve the objects of the invention.

The amount of peroxide (D-1) added per 100 parts by weight of the base rubber (A) is preferably at least 0.05 part, more preferably at least 0.08 part, even more preferably at least 0.1 part, but preferably up to 0.5 part, more preferably up to 0.4 part, even more preferably up to 0.3 part. The amount of peroxide (D-2) added per 100 parts by weight of the base rubber (A) is preferably at least 0.05 part, more preferably at least 0.15 part, even more preferably at least 0.2 part, but preferably up to 0.7 part, more preferably up to 0.6 part, even more preferably up to 0.5 part.

Component E

Suitable organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salts thereof, and organosulfur compounds having 2 to 4 sulfurs, such as diphenylpolysulfides, dibenzylpolysulfides, dibenzoylpolysulfides, dibenzothiazoylpolysulfides, dithiobenzoylpolysulfides, alkylphenyldisulfides, sulfur compounds having a furan ring, and sulfur compounds having a thiophene ring. Diphenyl disulfide and the zinc salt of pentachlorothiophenol are especially preferred.

The organosulfur compound (E) is included in an amount of at least 0.1 part, preferably at least 0.2 part, more preferably at least 0.4 part, even more preferably at least 0.7 part, and most preferably at least 0.9 part by weight, but up to 5 parts, preferably up to 4 parts, more preferably up to 3 parts, even more preferably up to 2 parts, and most preferably up to 1.5 parts, per 100 parts of the base rubber (A). Too little component (E) fails to provide a resilience-improving effect, whereas too much results in an excessively low hardness and thus insufficient resilience. In either case, the objects of the invention are not achievable.

If necessary, the rubber composition may include also an antioxidant in an amount of at least 0.05 part, preferably at least 0.1 part, and more preferably at least 0.2 part, but up to 3 parts, preferably up to 2 parts, more preferably up to 1 part, and most preferably up to 0.5 part, per 100 parts of component (A). The antioxidant may be a commercially available product, such as Nocrac NS-6 and NS-30 (both made by Ouchi Shinko Chemical Industry Co., Ltd.), and Yoshinox 425 (made by Yoshitomi Pharmaceutical Industries, Ltd.).

The molded and vulcanized product of the invention can be obtained by molding and vulcanizing/curing the above-described rubber composition using a method like that used with well-known golf ball rubber compositions. For example, vulcanization may be carried out at a temperature of about 100 to 200° C. for a period of about 10 to 40 minutes.

In the invention, the molded and vulcanized product should have a resilience of at least 74% as measured by a Dunlop tripsometer at a dropping angle of 40°, a sample thickness of 4 mm and a temperature of 23° C. The resilience is preferably at least 74.2%, more preferably at least 74.4%, even more preferably at least 74.7%. The upper limit of resilience is typically up to 90%, preferably up to 87%, more preferably up to 83%. The objects of the invention are not achievable if the molded and vulcanized product of the invention has a resilience of less than 74%, which means that the product is less rebound.

The hardness of the molded and vulcanized product may be suitably adjusted in accordance with the use of a particular golf ball and is not particularly limited. The hardness distribution in cross section of the molded product may be flat from the center to the surface thereof or have a hardness difference between the center and the surface thereof.

The construction of the inventive golf ball is not particularly limited as long as it comprises a molded and vulcanized product of the rubber composition as a constituent component. Various forms of golf balls are possible including one-piece golf balls in which the molded and vulcanized product is directly embodied as a ball, two-piece solid golf balls in which the molded and vulcanized product is a solid core and a cover is formed therearound, multi-piece solid golf balls in which the molded and vulcanized product is a solid core and a cover of two or more layers is formed therearound, and wound golf balls in which the molded and vulcanized product is a center core. Of these, two-piece and multi-piece solid golf balls in which the molded and vulcanized product of the invention is embodied as a solid core are preferred because the characteristics of the molded product are most effectively exploited so that the finished golf ball is endowed with better rebound.

When the golf ball is a one-piece golf ball or a golf ball having a solid core or solid center, it is recommended that said one-piece golf ball or solid core or solid center yield an amount of deflection or deformation under an applied load of 980 N (100 kg) of generally at least 2.0 mm, preferably at least 2.5 mm, more preferably 2.8 mm, most preferably at least 3.2 mm, and up to 6.0 mm, preferably up to 5.5 mm, more preferably up to 5.0 mm, most preferably up to 4.5 mm. Too small a deflection may worsen the feel of the ball upon impact and, particularly on long shots such as with a driver in which the ball incurs a large deformation, may subject the ball to an excessive rise in spin, reducing the carry. On the other hand, if the molded product is too soft, the golf ball tends to have a dead feel when hit, an inadequate rebound that results in a poor carry, and a poor durability to cracking with repeated impact.

In the embodiment wherein the molded and vulcanized product of the invention is embodied as a solid core, the solid core generally has a diameter of at least 30.0 mm, preferably at least 32.0 mm, more preferably at least 35.0 mm, even more preferably at least 37.0 mm, and up to 41.0 mm, preferably up to 40.5 mm, more preferably up to 40.0 mm, even more preferably up to 39.5 mm. For two-piece solid golf balls, the solid core generally has a diameter of at least 37.0 mm, preferably at least 37.5 mm, more preferably at least 38.0 mm, even more preferably at least 38.5 mm, and up to 41.0 mm, preferably up to 40.5 mm, more preferably up to 40.0 mm. For three-piece solid golf balls, the solid core generally has a diameter of at least 30.0 mm, preferably at least 32.0 mm, more preferably at least 34.0 mm, even more preferably at least 35.0 mm, and up to 40.0 mm, preferably up to 39.5 mm, more preferably up to 39.0 mm. The solid core generally has a specific gravity of at least 0.9, preferably at least 1.0, more preferably at least 1.1. The upper limit of specific gravity is generally up to 1.4, preferably up to 1.3, more preferably up to 1.2.

When the golf ball of the invention is embodied as a two-piece or multi-piece solid golf ball, it may be manufactured by using the molded and vulcanized product as the solid core, and injection molding or compression molding a well-known cover stock or intermediate layer material therearound.

Examples of the base of the cover stock or intermediate layer material include thermoplastic or thermosetting polyurethane elastomers, polyester elastomers, ionomer resins, polyolefin elastomers and mixtures thereof. Any one or mixture of two or more thereof may be used, although the use of a thermoplastic polyurethane elastomer or ionomer resin is especially preferred.

Illustrative examples of thermoplastic polyurethane elastomers that may be used herein include commercial products in which the diisocyanate is aliphatic or aromatic, such as Pandex T7298, T7295, T7890, TR3080, T8295, T8290 and T8260 (all manufactured by DIC Bayer Polymer Ltd.). Illustrative examples of suitable commercial ionomer resins include Surlyn 6320, 8120, and 9945 (both products of E.I. du Pont de Nemours and Co., Inc.), and Himilan 1706, 1605, 1855, 1601 and 1557 (all products of DuPont-Mitsui Polychemicals Co., Ltd.).

Together with the base described above, the cover or intermediate layer material may include also, as an optional constituent, polymers (e.g., thermoplastic elastomers) other than the foregoing. Specific examples of polymers that may be included as optional constituents include polyamide elastomers, styrene block elastomers, hydrogenated polybutadienes and ethylene-vinyl acetate (EVA) copolymers.

Golf balls according to the invention can be manufactured by a known method. No particular limitation is imposed on the manufacturing method. Two-piece and multi-piece solid golf balls are preferably manufactured by employing a method in which the above-described molded and vulcanized product is placed as the solid core within a given injection mold, following which a predetermined method is used to inject the above-described cover material over the core in the case of a two-piece solid golf ball, or to successively inject the above-described intermediate layer material and cover material in the case of a multi-piece solid golf ball. In some cases, the golf ball may be produced by molding the cover material under an applied pressure.

It is recommended that the intermediate layer in a multi-piece solid golf ball have a thickness of at least 0.5 mm, and preferably at least 1.0 mm, but not more than 3.0 mm, preferably not more than 2.5 mm, and more preferably not more than 2.0 mm.

Moreover, in both two-piece solid golf balls and multi-piece solid golf balls, it is recommended that the cover have a thickness of at least 0.7 mm and preferably at least 1.0 mm, but not more than 3.0 mm, preferably not more than 2.5 mm, more preferably not more than 2.0 mm, and most preferably not more than 1.6 mm.

The golf ball of the invention can be manufactured for competitive use by imparting the ball with a diameter and weight which conform with the Rules of Golf; that is, a diameter of at least 42.67 mm and a weight of not more than 45.93 g. It is recommended that the diameter be no more than 44.0 mm, preferably no more than 43.5 mm, and most preferably no more than 43.0 mm; and that the weight be at least 44.5 g, preferably at least 45.0 g, more preferably at least 45.1 g, and most preferably at least 45.2 g.

EXAMPLE

The following examples and comparative examples are provided to illustrate the invention, and are not intended to limit the scope thereof.

Examples 1-3 and Comparative Examples 1-3

A rubber composition was prepared by using a polybutadiene(s) shown in Table 1 and milling with other components in accordance with the recipe shown in Table 2. The composition was molded and vulcanized at 160° C. for 15 minutes, forming a two-piece golf ball core. The core had an outer diameter of 38.9 mm and a weight of 36.0 g. The core was held in a mold, after which a cover material in the form of a 1:1 (by weight) mixture of Himilan 1601 and Himilan 1557 (DuPont-Mitsui Polychemicals Co., Ltd.) was injected around the core to form a cover on which dimples were formed at the same time. The cover surface was coated with a paint, completing a two-piece solid golf ball having an outer diameter of 42.7 mm and a weight of 45.3 g.

The cores were determined for a deflection amount under a load of 100 kg (980 N), resilience and ease of extrusion. The golf balls were examined for flight performance. The results are shown in Table 2.

TABLE 1

| | Polybutadiene | | |
|---|---|---|---|
| Type | BSS1 | BR51 | BR01 |
| Manufacturer | OMCT | JSR | JSR |
| Catalyst | Sm | Nd | Ni |
| Cis-1,4 bond content (%) | 99.1 | 96 | 96 |
| Trans-1,4 bond content (%) | 0.3 | 2.7 | 1.5 |
| 1,2-vinyl bond content (%) | 0.6 | 1.3 | 2.5 |
| Mooney viscosity | — | 35.5 | 46 |
| Mw ($\times 10^4$) | 75 | — | — |
| Mw/Mn | 1.9 | 2.8 | 4.2 |

Type/Manufacturer:

BSS1 is a trade name of polybutadiene by OM Chem Tech. Ltd.

BR51 and BR01 are trade names of polybutadine by JSR Corporation.

Catalyst:

the type of active center metal in the catalyst used in the synthesis of polybutadiene.

Cis-1,4 bond content:

the proportion (wt %) of cis-1,4 bonds in polybutadiene molecule.

Trans-1,4 bond content:

the proportion (wt %) of trans-1,4 bonds in polybutadiene molecule.

1,2-vinyl bond content:

the proportion (wt %) of 1,2-vinyl bonds in polybutadiene molecule.

Mooney viscosity:

$ML_{1+4}$(100° C.) according to JIS K6300

TABLE 2

| Formulation (pbw) | | | | Example 1 | Example 2 | Example 3 | Comparative Example 1 | Comparative Example 2 | Comparative Example 3 |
|---|---|---|---|---|---|---|---|---|---|
| Core composition | A | BSS1 | | 100 | 90 | 70 | | 30 | 100 |
| | | BR51 | | | 10 | 30 | | 70 | |
| | | BR01 | | | | | 100 | | |
| | B | Zinc acrylate | | 24.5 | 24.5 | 24.5 | 24.5 | 24.5 | 22 |
| | C | Zinc oxide | | 21 | 21 | 21 | 21 | 21 | 22.5 |
| | D | (D-1) Perhexa 3M-40 | Apparent amount | 0.6 | 0.6 | 0.6 | 0.6 | 0.6 | 0.6 |
| | | | Net amount | 0.24 | 0.24 | 0.24 | 0.24 | 0.24 | 0.24 |
| | | (D-2) Percumyl D | | 0.6 | 0.6 | 0.6 | 0.6 | 0.6 | 0.6 |
| | E | Zinc salt of pentachlorothiophenol | | 0.8 | 0.8 | 0.8 | 0.8 | 0.8 | 0 |
| | Antioxidant | | | 0.1 | 0.1 | 0.1 | 0.1 | 0.1 | 0.1 |
| Core properties | Deflection under 100 kg load (mm) | | | 3.7 | 3.7 | 3.6 | 3.7 | 3.6 | 3.7 |
| | Resilience (%) | | | 75.0 | 74.5 | 74.4 | 73.0 | 73.7 | 71.4 |
| | Extrudability | | | 1 | 3 | 4 | 3 | 4 | 1 |
| Golf ball properties | W#1/HS45 carry (m) | | | 215.6 | 214.5 | 214.7 | 211.5 | 212.3 | 203.2 |
| | W#1/HS45 total (m) | | | 232.1 | 231.1 | 231.3 | 227.9 | 228.7 | 219.8 |

Perhexa 3M-40:

1,1-bis(t-butylperoxy)-3,3,5-trimethylcyclohexane, used in 40 wt % dilution with $SiO_2$ and $CaCO_3$, by NOF Corp.

Percumyl D:

dicumyl peroxide by NOF Corp.

Antioxidant:

2,2'-methylenebis(4-methyl-6-t-butylphenol) by Ouchi Shinko Chemical Industry Co., Ltd.

Deflection under 100 kg load:

Measured was an amount (mm) of deflection of the solid core under an applied load of 100 kg (980 N).

Resilience:

Measured by a Dunlop tripsometer at a dropping angle 40°, sample thickness 4 mm, temperature 23° C.

Extrudability:

The composition was extruded into a slug whose texture and shape were rated by the following criterion.

4: neat slug texture, very good

3: slightly ragged slug texture, good

2: fluffy slug texture, extrudable

1: deficient slug shape, difficult to extrude an amount.

Golf ball properties:

Using a hitting machine, the golf ball was hit with a driver (W#1, Tour Stage X500, loft 9°, shaft X, by Bridgestone Sports Co., Ltd.) at a head speed of 45 m/s (HS45). Flight performance was examined in terms of a carry (m) and a total distance (m).

In Comparative Example 1, the low resilience polybutadiene polymerized in the presence of a Ni-base catalyst is used alone to form a rubber composition with a low resilience, which accounts for a short flight distance.

In Comparative Example 2, the low resilience polybutadiene polymerized in the presence of a Ni-base catalyst is used in a large amount to form a rubber composition which is effectively workable, but has a low resilience, which accounts for a short flight distance.

In Comparative Example 3, a rubber composition free of the zinc salt of pentachlorothiophenol has a low resilience, which accounts for a short flight distance.

Example 4 and Comparative Example 4

A rubber composition was prepared by using a polybutadiene(s) shown in Table 1 and milling with other components in accordance with the recipe shown in Table 3. The composition was molded and vulcanized at 160° C. for 15 minutes, forming a three-piece golf ball core. The core had an outer diameter of 36.4 mm and a weight of 29.7 g. The core was held in a mold, after which a mixture of Surlyn 9945 (DuPont), Himilan 1605 (DuPont-Mitsui Polychemicals Co., Ltd.) and Dynaron 6100P (JSR Corp.) in a weight ratio of 35:35:30 was injected around the core to form an intermediate layer of 1.65 mm thick.

A cover material in the form of a mixture of Pandex T8260 and Pandex T8295 (DIC Bayer Polymer Ltd.) in a weight ratio of 1:1 was further injected to form a cover of 1.5 mm thick, completing a three-piece solid golf ball having an outer diameter of 42.7 mm and a weight of 45.5 g.

The cores were determined for a deflection amount under a load of 100 kg (980 N), resilience and ease of extrusion. The golf balls were examined for flight performance. The results of tests (done as in Table 2) are shown in Table 3.

TABLE 3

| | Formulation (pbw) | | | Example 4 | Comparative Example 4 |
|---|---|---|---|---|---|
| Core composition | A | BSS1 | | 85 | |
| | | BR51 | | 15 | |
| | | BR01 | | | 100 |
| | B | Zinc acrylate | | 24.5 | 24.5 |
| | C | Zinc oxide | | 22.5 | 22.5 |
| | D | (D-1) Perhexa 3M-40 | Apparent amount | 0.6 | 0.6 |
| | | | Net amount | 0.24 | 0.24 |
| | | (D-2) Percumyl D | | 0.6 | 0.6 |
| | E | Zinc salt of pentachlorothiophenol | | 0.8 | 0.8 |
| | Antioxidant | | | 0.1 | 0.1 |
| Core properties | Deflection under 100 kg load (mm) | | | 3.9 | 3.9 |
| | Resilience (%) | | | 74.7 | 73.1 |
| | Extrudability | | | 3 | 3 |
| Golf ball properties | W#1/HS45 carry (m) | | | 226.5 | 213.3 |
| | W#1/HS45 total (m) | | | 234.5 | 230.3 |

In Comparative Example 4, the low resilience polybutadiene polymerized in the presence of a Ni-base catalyst is used alone to form a rubber composition with a low resilience, which accounts for a short flight distance.

Japanese Patent Application No. 2003-350660 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising as a constituent component a molded and vulcanized product of a rubber composition comprising (A) 100 parts by weight of a base rubber, (B) 10 to 60 parts by weight of an unsaturated carboxylic acid and/or a metal salt thereof, (C) 1 to 80 parts by weight of an inorganic filler, (D) 0.05 to 3 parts by weight of an organic peroxide, and (E) 0.1 to 5 parts by weight of an organosulfur compound, wherein said component (A) comprises (A-1) a polybutadiene having a weight average molecular weight (Mw) of $60\times10^4$ to $150\times10^4$ and a dispersity (Mw/Mn) of up to 2.0, and containing at least 98% of cis-1,4 bonds and up to 1.5% of trans-1,4 bonds in the molecule, and (A-2) 5 to 50% by weight of a polybutadiene which has been synthesized using a neodymium catalyst, said component (D) comprises an organic peroxide (D-1) having the shortest half-life at 155° C. and another organic peroxide (D-2) having the longest half-life at 155° C., the half-life of (D-1) is t(D-1), the half-life of (D-2) is t(D-2), and the ratio of half-lives t(D-2)/t(D-1) is at least 7 and up to 20, and said molded and vulcanized product has a resilience of at least 74%.

2. The golf ball of claim 1, wherein said molded and vulcanized product is used as a solid core of a two-piece solid golf ball or a three or multi-piece solid golf ball.

3. The golf ball of claim 1, wherein the polybutadiene (A-1) has been synthesized in the presence of a catalyst composition comprising a metallocene complex of a rare earth metal compound and at least one of an ionic compound of a non-coordinate anion and a cation and an aluminoxane.

4. The golf ball of claim 1, wherein the polybutadiene of (A-2) has a dispersity (Mw/Mn) of 2.0 to 6.0, contains at least 60% of cis-1,4 bonds in the molecule, and has a Mooney viscosity ($ML_{1+4}$(100° C.)) of up to 55.

* * * * *